US006814679B1

(12) United States Patent
Chen

(10) Patent No.: US 6,814,679 B1
(45) Date of Patent: Nov. 9, 2004

(54) BOOMERANG FOR SPORT

(76) Inventor: Ing-Chun Chen, No. 34, Han-Cheng 5th St., Hsi-Tun Dist. Taichung City (TW)

( * ) Notice: Subject to any disclaimer, the term of this patent is extended or adjusted under 35 U.S.C. 154(b) by 0 days.

(21) Appl. No.: 10/658,026

(22) Filed: Sep. 9, 2003

(51) Int. Cl.[7] ..... A63B 65/08
(52) U.S. Cl. ..... 473/590
(58) Field of Search ..... 473/589, 590, 473/588; 446/46

(56) References Cited

U.S. PATENT DOCUMENTS

| | | | | |
|---|---|---|---|---|
| 2,972,481 A | * | 2/1961 | Shapiro | 473/590 |
| 3,881,729 A | | 5/1975 | Block et al. | |
| 4,421,320 A | * | 12/1983 | Robson | 473/590 |
| 5,199,717 A | * | 4/1993 | Wimmer | 473/590 |
| 5,615,892 A | | 4/1997 | Miller | |
| D389,878 S | | 1/1998 | Tylor | |
| 6,179,738 B1 | | 1/2001 | Perthou | |
| 6,659,832 B1 | * | 12/2003 | Chen | 473/590 |
| 2001/0024923 A1 | | 9/2001 | Streit | |
| 2003/0083160 A1 | | 5/2003 | Ben-Hador | |

FOREIGN PATENT DOCUMENTS

| | | | |
|---|---|---|---|
| JP | 112382 | A1 | 5/1996 |
| JP | 159604 | A1 | 6/2002 |
| WO | WO-98/26844 | A1 | 6/1998 |

* cited by examiner

*Primary Examiner*—Steven Wong
(74) *Attorney, Agent, or Firm*—Darby & Darby

(57) ABSTRACT

A boomerang is made from a flat sheet material, and includes interconnecting portions angularly displaced from one another about a center point, and terminating at an arc boundary that cooperates with the center point to define a radius, and blades integrally and respectively formed with the interconnecting portions. Each blade has a bent line which extends from an outer point at a distal edge to an inner point at the arc boundary, and which is of a length that is equal to the radius. The bent line meets a radius line at the arc boundary to form a vertex with an included angle of obtuseness. Varying the interior angle formed by each of the bent line and the radius line with a base line interconnecting the outer point and the center point can change flight patterns of the boomerang.

3 Claims, 6 Drawing Sheets

BOOMERANG FOR SPORT

BACKGROUND OF THE INVENTION

1. Field of the Invention

This invention relates to a boomerang for sport, more particularly to a boomerang made from a flat sheet material and having blades formed with bent portions for creating a lift during flight.

2. Description of the Related Art

Conventional boomerangs for sport are generally required to have a sufficient thickness in order to produce a desired lift according to Bernoulli's law, thereby resulting in a greater weight thereof, which in turn results in a larger flight range. Therefore, the conventional boomerangs as such generally cannot be used in a relatively narrow area.

Another type of boomerang is proposed to be made from a thin plate so as to reduce the overall weight of the boomerang. However, as the flight radius of the boomerang is relatively small and as the flight path thereof is monotonous, the boomerang is not interesting to play with.

SUMMARY OF THE INVENTION

The object of the present invention is to provide a boomerang which can be manufactured easily and which permits control of flight patterns thereof.

According to this invention, the boomerang is made from a flat sheet material, and includes a central body with an outer periphery surrounding a center point. The central body has top and bottom surfaces substantially parallel to each other and in symmetry to a horizontal plane. A plurality of interconnecting portions are integrally formed with the outer periphery of the central body, and are angularly displaced from one another about the center point. Each of the interconnecting portions extends outwardly and along a radial axis, and terminates at an arc boundary. The arc boundaries of the interconnecting portions cooperatively define a circumference having a radius. A plurality of blades are formed integrally and respectively with the interconnecting portions, and are angularly displaced from one another. Each of the blades includes leading and trailing edges which are opposite to each other in one of clockwise and counterclockwise directions when the blades are turned about an axis that is normal to the horizontal plane, and that passes through the center point. Each of the blades further includes a distal edge which is opposite to the arc boundary of the respective one of the interconnecting portions, and which joins with the leading and trailing edges at leading and trailing junctures, respectively. Each of the blades further includes a bent line which extends from an outer point at the distal edge to an inner point at the are boundary, and which is of a length that is equal to the radius. The bent line meets a radius line at the arc boundary to form a vertex with an included angle of obtuseness that faces towards the leading edge. A bent portion is formed by the bent line and the trailing edge, and forms with the horizontal plane an included angle of obtuseness that faces downwards.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
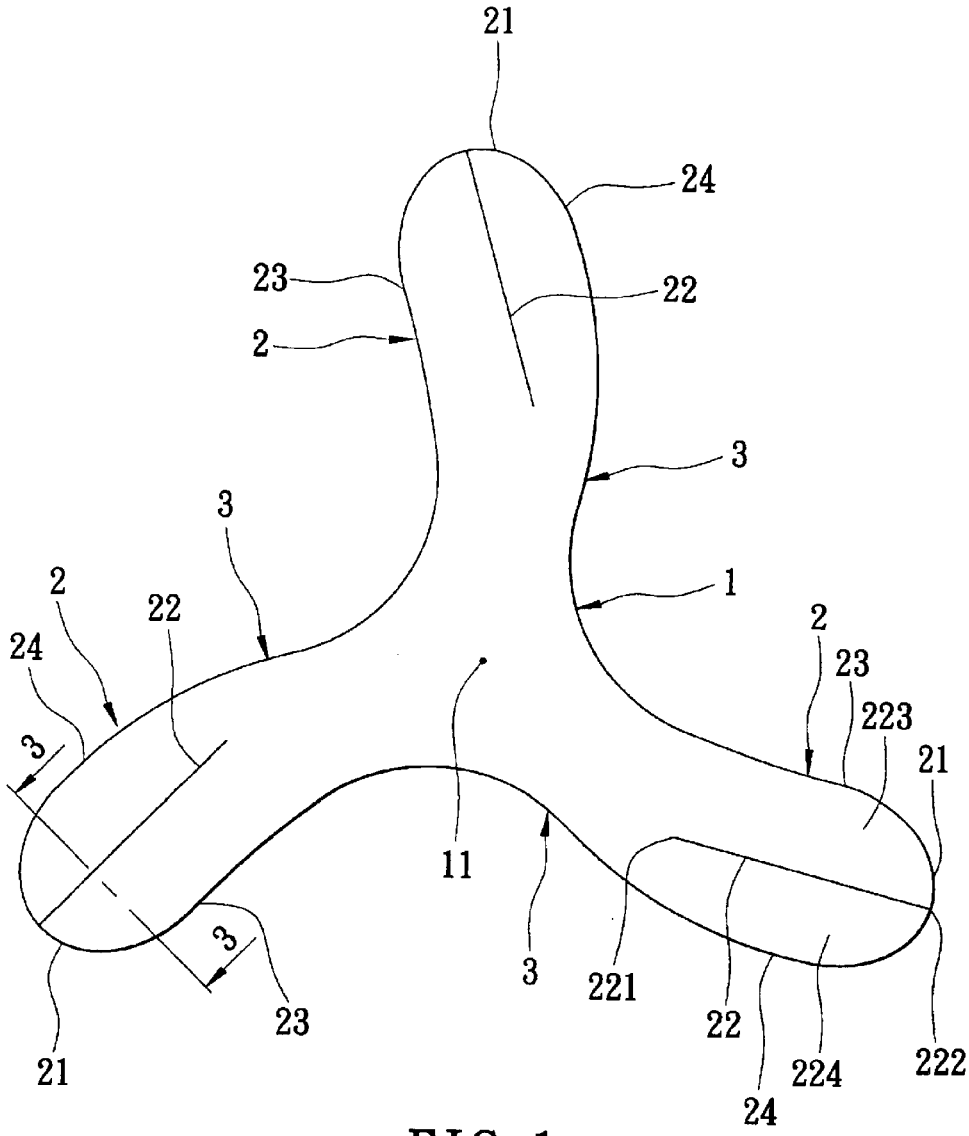
FIG. 1 is a top view of a first preferred embodiment of a boomerang according to this invention.

Before the present invention is described in greater detail, it should be noted that same reference numerals have been used to denote like elements throughout the specification.

Figure 2:
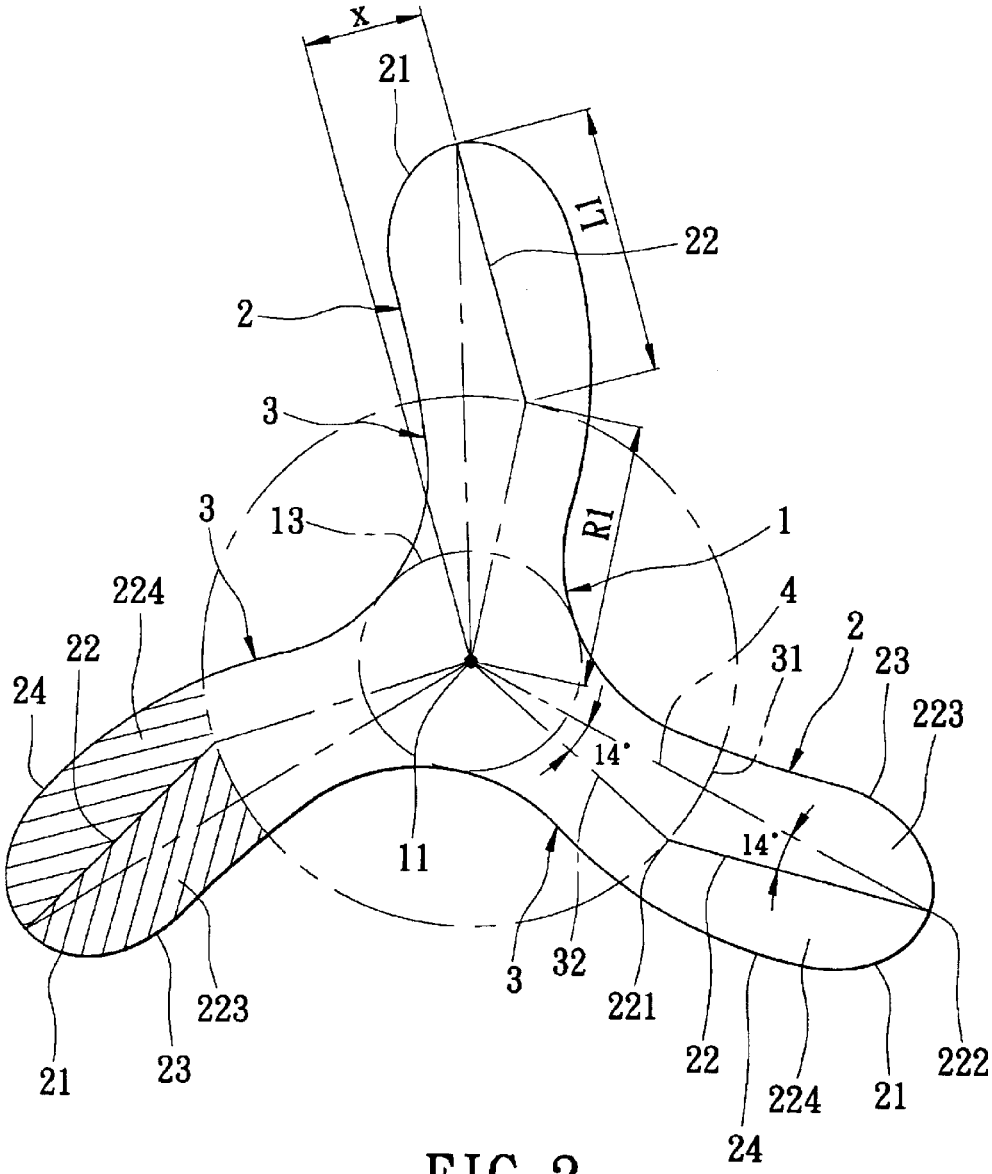
FIG. 2 is a top view of the first preferred embodiment showing the relationship between a center point and a bent line.
Figure 3:
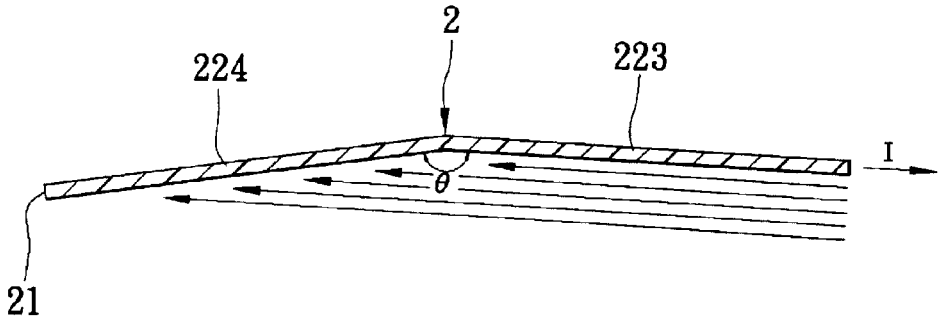
FIG. 3 is a cross-sectional view of the boomerang shown in FIG. 1, taken along line 3—3 thereof.

Referring to FIGS. 1 to 3, the first preferred embodiment of a boomerang according to the present invention is formed from a thin, flat sheet material of a substantially uniform thickness, and has a single-piece construction. The boomerang is shown to comprise a central body 1, three interconnecting portions 3, and three blades 2.

The central body 1 has an outer periphery 13 surrounding a center point 11 (i.e., center of mass of the boomerang). The central body 1 has top and bottom surfaces substantially parallel to each other and in symmetry to a horizontal plane. The interconnecting portions 3 are integrally formed with the outer periphery 13 of the central body 1, and are angularly displaced from one another about the center point 11. Each of the interconnecting portions 3 extends outwardly and along a radial axis, and terminates at an arc boundary 31. The arc boundaries 31 of the interconnecting portions 3 cooperatively define a circumference having a radius (R1). The blades 2 are formed integrally and respectively with the interconnecting portions 3, and are angularly displaced from one another. Each of the blades 2 includes leading and trailing edges 23, 24 which are opposite to each other in one of clockwise and counterclockwise directions when the blades 2 are turned about an axis that is normal to the horizontal plane and that passes through the center point 11. A distal edge 21 is opposite to the arc boundary 31 of the respective interconnecting portion 3, and joins with the leading and trailing edges 23, 24 at leading and trailing junctures, respectively. A bent line 22 extends from an outer point 222 at the distal edge 21 to an inner point 221 at the arc boundary 31, and is of a length (L1) that is equal to (R1). The bent line 22 meets a radius line 32 at the arc boundary 31 to form a vertex with an included angle of obtuseness that faces towards the leading edge 23. Each of the bent line 22 and the radius line 32 forms with a base line 4, which interconnects the outer point 222 and the center point 11, an interior angle ranging from 10 degrees to 17.5 degrees (14 degrees in this embodiment). Note that when the interior angle is relatively small, the boomerang flies with a relatively large lift force so as to fly high. When the interior angle is relatively large, the boomerang flies with a relatively small lift force so as to fly low.

In addition, a plane portion 223 is formed by the bent line 22 and the leading edge 23. A bent portion 224 is formed by the bent line 22 and the trailing edge 24, and forms with the bent portion 224 an included angle (θ) of obtuseness that faces downwards. Preferably, the ratio of area of the plane portion 223 to the bent portion 224 ranges from 6:4 to 5:5.

Figure 4:
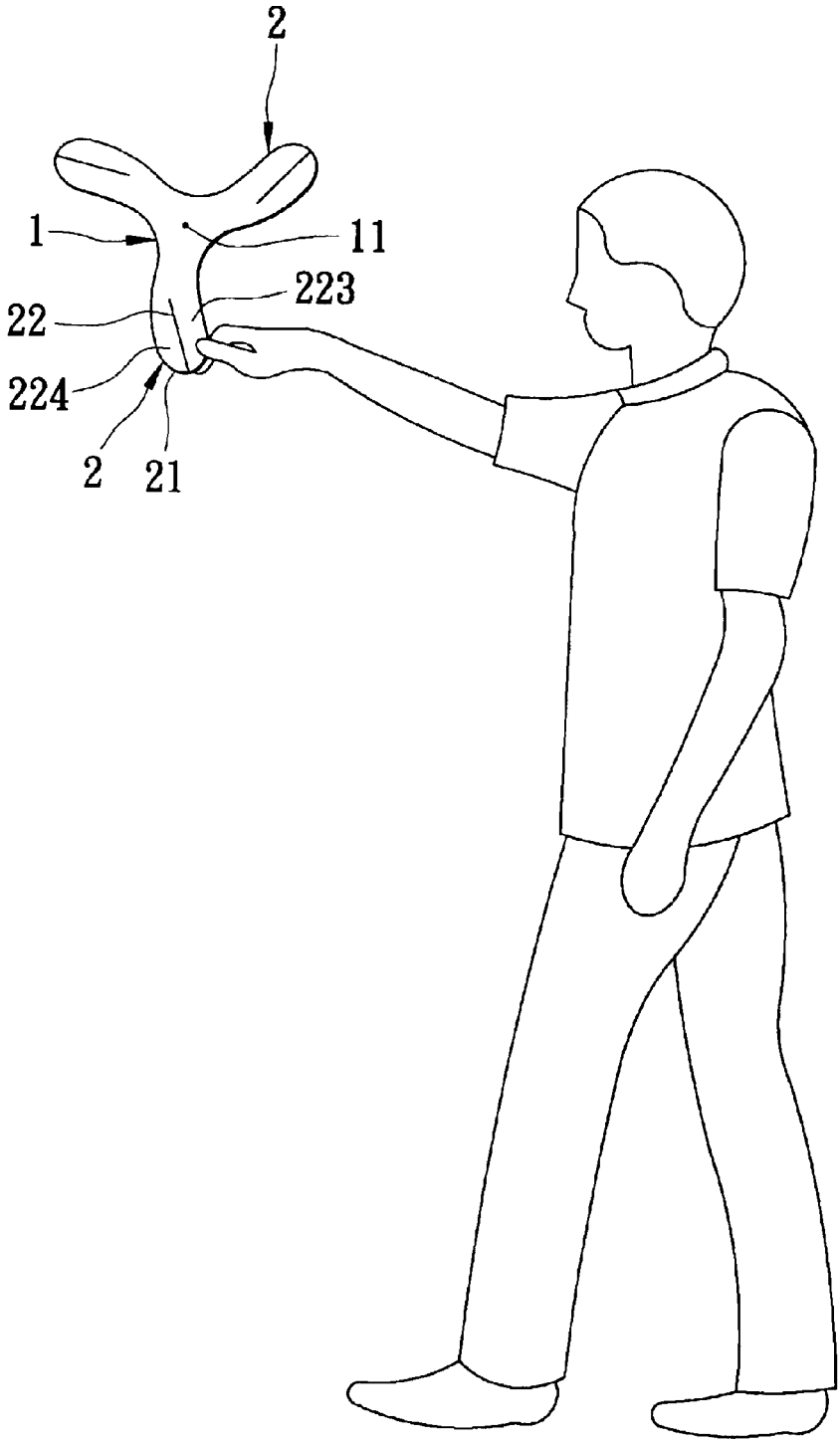
FIG. 4 is a schematic view illustrating how the first preferred embodiment is held by the thrower.

With reference to FIGS. 3 and 4, the thrower can hold the plane portion 223 of one of the blades 2, and then throw the boomerang in a direction indicated by arrow (I). The boomerang will rotate about the axis passing through the center point 11, and then return to the point of launching. Accordingly, the bent line 22 of each blade 2 is offset from the center point 11 by an offset distance (X). Since the offset distance (X) can decrease a torque generated when more lift is generated in front of the center point 11 than behind the center point 11 during flight, the height of flight of the boomerang can be varied by adjusting the of set distance (X). Besides, the flight range can be varied by adjusting the included angle (θ) and the interior angles. Therefore, with the provision of the offset distance (X), the included angle (θ) of obtuseness and the interior angle, and the relationship of the radius (R1) and the length (L1) of the radius line 32, the boomerang of this invention can perform a desired flight pattern.

Figure 5:
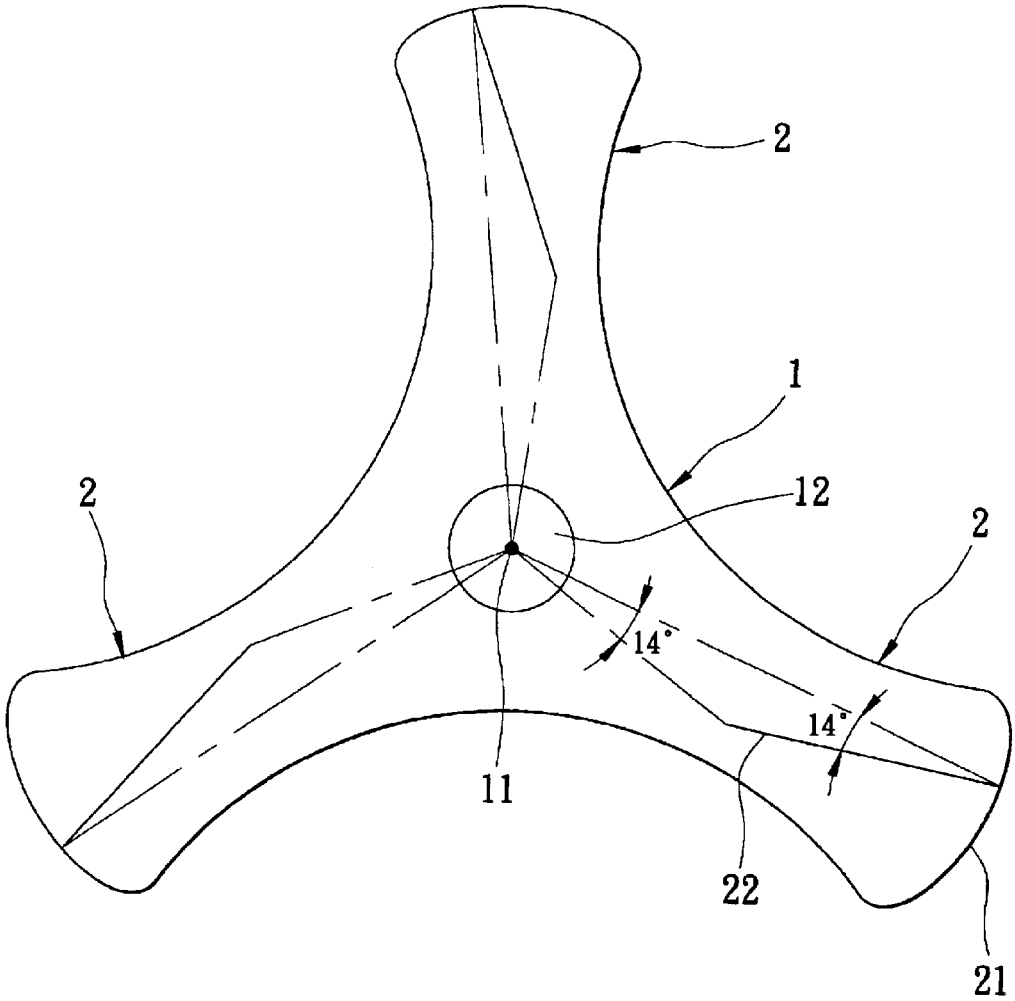
FIG. 5 is a top view of a second preferred embodiment of the boomerang according to this invention.
Figure 6:
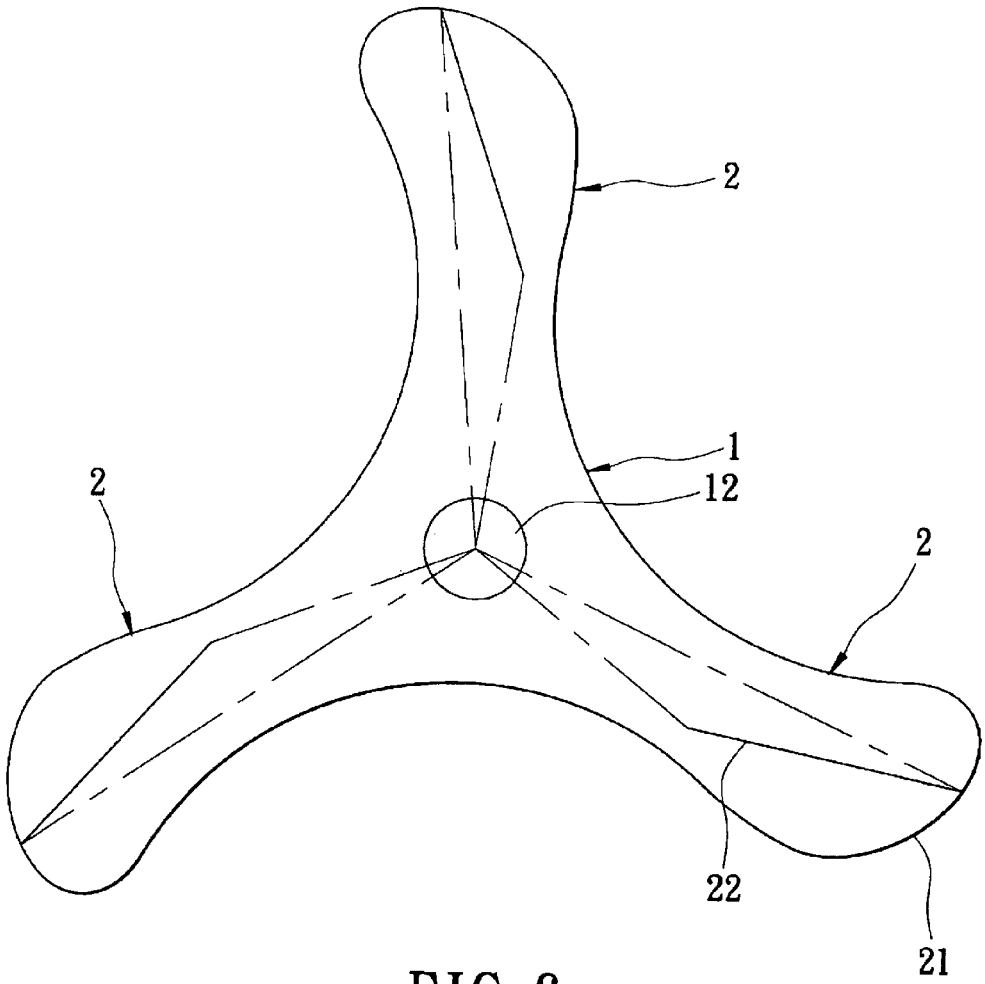
FIG. 6 is a top view of a third preferred embodiment of the boomerang according to this invention.

Moreover, since the boomerang according to this invention is made from a thin flat sheet material, it has a smaller rotational inertia so that a relatively small lift force is required for rotation thereof. Therefore, the boomerang of this invention is lighter and safer. Referring to FIGS. 5 and 6, the second and third preferred embodiments of the boomerang according to this invention are shown to be similar to the first embodiment in construction, except that a through hole 12 is formed in the central body 1 and extends from the top surface to the bottom surface. The through hole 12 is shown to be circular and surrounds the axis passing through the center point 11. As such, the weight of the boomerang is decreased, and the gyration stability of the boomerang is increased. It is noted that the through hole 12 can have a rectangular or triangular shape. Moreover, the blades 2 of the boomerangs of the second and third embodiments have shapes that differ from those of the first embodiment.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A boomerang made from a flat sheet material, comprising:

a central body with an outer periphery surrounding a center point, said central body having top and bottom surfaces substantially parallel to each other and in symmetry to a horizontal plane;

a plurality of interconnecting portions integrally formed with said outer periphery, and angularly displaced from one another about the center point, each of said interconnecting portions extending outwardly and along a radial axis, and terminating at an arc boundary, said arc boundaries of said interconnecting portions cooperatively defining a circumference having a radius; and a plurality of blades formed integrally and respectively with said interconnecting portions, and angularly displaced from one another, each of said blades including leading and trailing edges which are opposite to each other in one of clockwise and counterclockwise directions when said blades are turned about an axis that is normal to the horizontal plane and that passes through the center point, a distal edge which is opposite to said arc boundary of the respective one of said interconnecting portions, and which joins with said leading and trailing edges at leading and trailing junctures, respectively, a bent line which extends from an outer point at said distal edge to an inner point at said arc boundary, and which is of a length that is equal to the radius, said bent line meeting a radius line at said arc boundary to form a vertex with an included angle of obtuseness that faces towards said leading edge, and a bent portion which is formed by said bent line and said trailing edge, and which forms with the horizontal plane an included angle of obtuseness that faces downwards.

2. The boomerang of claim 1, wherein each of said bent line and said radius line forms with a base line, which interconnects said outer point and said center point, an interior angle ranging from 10 degrees to 17.5 degrees.

3. The boomerang of claim 2, wherein each of said blades further includes a plane portion which is formed by said bent line and said leading edge, a ratio of area of said plane portion to said bent portion ranging from 6:4 to 5:5.

* * * * *